US007963279B2

(12) United States Patent
Harwath et al.

(10) Patent No.: US 7,963,279 B2
(45) Date of Patent: Jun. 21, 2011

(54) DROP-AWAY ARROW REST

(75) Inventors: Frank A. Harwath, Naperville, IL (US); Miroslav A. Simo, Riverside, IL (US); Christopher A. Kozlik, Schaumburg, IL (US)

(73) Assignee: New Archery Products Corp., Forest Park, IL (US)

( * ) Notice: Subject to any disclaimer, the term of this patent is extended or adjusted under 35 U.S.C. 154(b) by 434 days.

(21) Appl. No.: 12/218,076

(22) Filed: Jul. 9, 2008

(65) Prior Publication Data

US 2010/0006079 A1 Jan. 14, 2010

(51) Int. Cl.
*F41B 5/22* (2006.01)

(52) U.S. Cl. ..... 124/44.5; 124/24.1; 124/86; 124/87; 124/88; 124/89

(58) Field of Classification Search ..... 124/24.1, 124/44.5, 86–89
See application file for complete search history.

(56) References Cited

U.S. PATENT DOCUMENTS 3,769,956 A * 11/1973 Simo ..... 124/44.5
4,074,674 A * 2/1978 Simo ..... 124/44.5
4,898,145 A * 2/1990 Simo ..... 124/44.5
5,063,678 A * 11/1991 Simo ..... 33/265
5,372,119 A * 12/1994 Kidney ..... 124/44.5
5,421,314 A * 6/1995 Kidney ..... 124/44.5
5,522,375 A * 6/1996 Simo et al. ..... 124/86
5,526,799 A * 6/1996 Simo ..... 124/44.5
5,697,356 A * 12/1997 Chappell ..... 124/44.5
5,722,381 A * 3/1998 Mizek ..... 124/44.5
5,743,245 A * 4/1998 Mizek ..... 124/44.5
5,960,779 A * 10/1999 Jessee et al. ..... 124/44.5
6,050,251 A * 4/2000 Harwath et al. ..... 124/44.5
6,089,216 A * 7/2000 Harwath et al. ..... 124/44.5
6,520,170 B1 * 2/2003 Adkins ..... 124/44.5
6,561,174 B1 * 5/2003 Afshari ..... 124/44.5
6,595,195 B1 * 7/2003 Barner et al. ..... 124/44.5
6,615,813 B1 * 9/2003 Troncoso et al. ..... 124/44.5
6,634,349 B2 * 10/2003 Mizek et al. ..... 124/44.5
6,637,419 B1 * 10/2003 Troncoso et al. ..... 124/44.5
6,684,871 B1 * 2/2004 Troncoso et al. ..... 124/44.5
6,688,297 B1 * 2/2004 Clague ..... 124/44.5
6,782,881 B2 * 8/2004 Mizek et al. ..... 124/44.5
6,823,856 B2 * 11/2004 Rager ..... 124/44.5
6,913,008 B2 * 7/2005 Simo et al. ..... 124/44.5
6,915,791 B2 * 7/2005 Harwath et al. ..... 124/44.5
6,938,616 B2 * 9/2005 Walk ..... 124/86
7,047,959 B2 5/2006 Simo et al.
7,100,591 B2 * 9/2006 Terry ..... 124/44.5
7,219,662 B1 * 5/2007 Henry ..... 124/44.5
(Continued)

OTHER PUBLICATIONS

Co-pending U.S. Appl. No. 11/820,486, filed Jun. 19, 2007, Release Device With Follow-Through.

*Primary Examiner* — Gene Kim
*Assistant Examiner* — Alexander R Niconovich
(74) *Attorney, Agent, or Firm* — Pauley Petersen & Erickson

(57) ABSTRACT

An arrow rest that drops away or otherwise moves away from a discharging shaft of an arrow or another projectile. An arrow holder is operable between two support positions and a launch position. A support force is used to keep or maintain the arrow holder in the support position. A movement force can be transferred to the arrow holder for overcoming the support force and moving the arrow rest into a launch position, away from a discharging arrow shaft and the corresponding fletching.

22 Claims, 16 Drawing Sheets

U.S. PATENT DOCUMENTS

| | | | | |
|---|---|---|---|---|
| 7,311,099 | B2 * | 12/2007 | Rager | 124/44.5 |
| 7,331,338 | B2 * | 2/2008 | Mizek | 124/44.5 |
| 7,409,950 | B2 * | 8/2008 | Ellig et al. | 124/44.5 |
| 7,597,095 | B2 * | 10/2009 | Grace et al. | 124/44.5 |
| 7,681,566 | B2 * | 3/2010 | Mertens | 124/44.5 |
| 2002/0096161 | A1 * | 7/2002 | Hulm | 124/44.5 |
| 2003/0024516 | A1 * | 2/2003 | Mizek et al. | 124/44.5 |
| 2003/0127083 | A1 * | 7/2003 | Musacchia, Jr. | 124/44.5 |
| 2003/0136393 | A1 * | 7/2003 | Barner et al. | 124/44.5 |
| 2004/0139952 | A1 * | 7/2004 | Simo et al. | 124/44.5 |
| 2004/0139953 | A1 * | 7/2004 | Harwath et al. | 124/44.5 |
| 2004/0139954 | A1 * | 7/2004 | Mizek et al. | 124/44.5 |
| 2006/0157038 | A1 * | 7/2006 | Ellig et al. | 124/44.5 |
| 2007/0079820 | A1 * | 4/2007 | Cooper | 124/44.5 |
| 2007/0119439 | A1 * | 5/2007 | Mizek | 124/44.5 |
| 2007/0163560 | A1 * | 7/2007 | Mertens | 124/44.5 |
| 2008/0168971 | A1 * | 7/2008 | Mizek et al. | 124/44.5 |
| 2008/0236556 | A1 * | 10/2008 | Sims et al. | 124/24.1 |
| 2009/0183720 | A1 * | 7/2009 | Hudkins | 124/44.5 |

* cited by examiner

DROP-AWAY ARROW REST

BACKGROUND OF THE INVENTION

1. Field of the Invention

This invention relates to a drop-away or a move-away arrow rest that moves between two different positions, a support position and a launch position, when a certain force is applied to move the arrow rest at a particular velocity. With the arrow rest of this invention, an archer can reposition, let down or draw down a bow without the arrow shaft falling away from its launch position in the arrow rest.

2. Discussion of Related Art

Many conventional drop-away arrow rests hold an arrow shaft in one position and move away from the arrow shaft when the arrow is launched from a bow. Some conventional drop-away arrow rests are moved into a launch position by drawing the bow into a launch or a shooting position. With such conventional arrow rests, as the bowstring is released, the arrow rest moves away or falls away from its supporting position.

One problem occurs when an archer lets down the bow or draws down the bow. Because many conventional drop-away arrow rests are mechanically connected to the bow string, when the bow string is drawn down or released without shooting the arrow, the arrow rest moves away from the arrow shaft and causes the arrow shaft to fall from its loaded position.

With conventional drop-away arrow rests, another problem occurs when the bow is moved out of a vertical or a shooting position, the arrow shaft can fall away from the arrow rest, which requires a reloading of the arrow shaft on the arrow rest.

SUMMARY OF THE INVENTION

With a drop-away arrow rest according to this invention, a shaft of an arrow or another projectile can be positioned and held with respect to an arrow holder so that when the archery bow or other shooting device is let down or repositioned, the arrow or other similar projectile does not fall down or away from the bow or other shooting device. When the shaft of an arrow is mounted in a loaded condition, the arrow holder can move between at least two support positions without moving further into a launch position.

Different forces applied to the arrow holder can cause the arrow holder to move at a velocity which is less than forces applied by a shooting velocity of the arrow shaft. Thus, the drop-away arrow rest of this invention can be used to allow an archer to draw down the bow or let down the bow, without the arrow shaft falling away from the arrow holder. The drop-away arrow rest of this invention can be designed to move further than or beyond any one or more of the support positions, into a launch position, by overcoming a support force which normally urges the arrow holder into one of the support positions. For example, the discharge acceleration or velocity of an arrow shot from a fired compound bow can be designed to overcome the support force normally urging the arrow rest into the support position and thus allow the arrow holder to move into the launch position. In certain embodiments of this invention, when in the launch position the arrow holder is moved away from the discharging arrow shaft and the associated fletching.

Different elements of this invention can be designed to provide an arrow rest that drops away from or moves away from a discharging arrow shaft, without using a cable attached to the bow string. Even without connecting the arrow rest to movement of the bow string, the arrow holder of this invention can be designed to move between two or more support positions at a relatively lower velocity, speed or acceleration that does not trigger or cause the arrow holder to move from one of the support positions to the launch position, away from the arrow shaft. At the same time, an arrow holder according to this invention can be designed to move away from any of the support positions into the launch position, away from the discharging arrow shaft, for example, when the arrow holder moves at a relatively higher acceleration, velocity or speed as compared to the relatively lower acceleration, velocity or speed resulting from bow movement or draw down.

An arrow holder according to this invention can have one or more support arms that hold or retain the shaft of an arrow or other projectile with respect to the arrow holder. In some embodiments of this invention, one or more bands, such as elastic bands, can be used alone or in combination with the support arms to retain or hold the shaft of an arrow or other projectile with respect to the arrow holder.

BRIEF DESCRIPTION OF THE DRAWINGS

The drawings show different features of an archery arrow rest according to preferred embodiments of this invention, wherein.

DETAILED DESCRIPTION OF THE INVENTION

As used throughout this specification and in the claims, the term arrow rest is intended to relate to and to be interchangeable with the terms drop-away arrow rest, move-away arrow rest, fall-away arrow rest and/or any other arrow rest or other similar device for resting or supporting a shaft of a projectile, such as an arrow and/or a crossbow bolt. Mizek et al., U.S. Pat. No. 6,782,881 and Mizek, U.S. Pat. No. 7,331,338, the entire teachings of both of which are incorporated into this specification by reference, teach different technical features and functions of arrow rests that move away from an arrow shaft when the arrow shaft is discharged from an archery bow.

The scope of this invention is intended to include archery bows, crossbows, or any other device that launches or propels a projectile.

Figure 1:
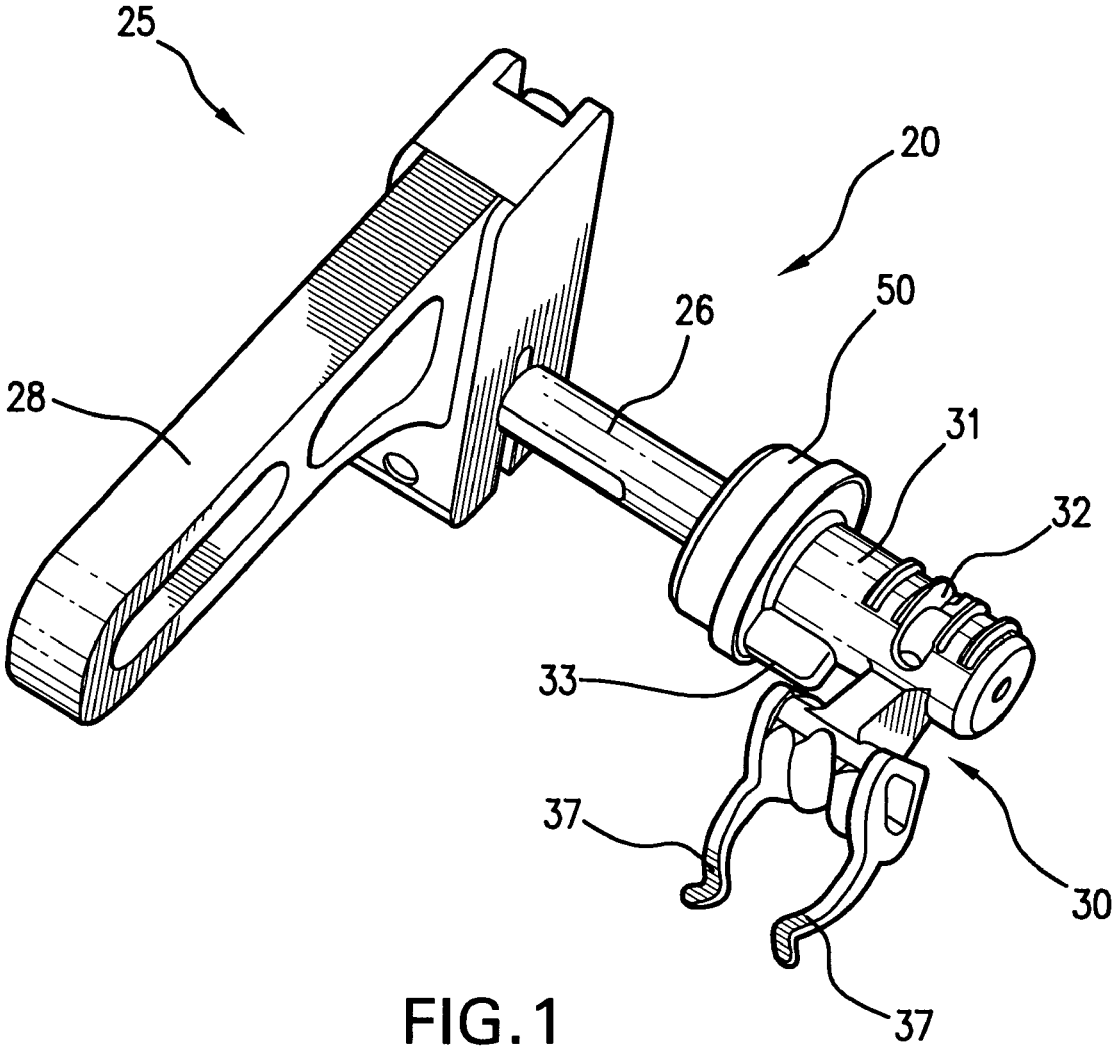
FIG. 1 is a front perspective view of an arrow rest assembly, according to one embodiment of this invention.
Figure 2:
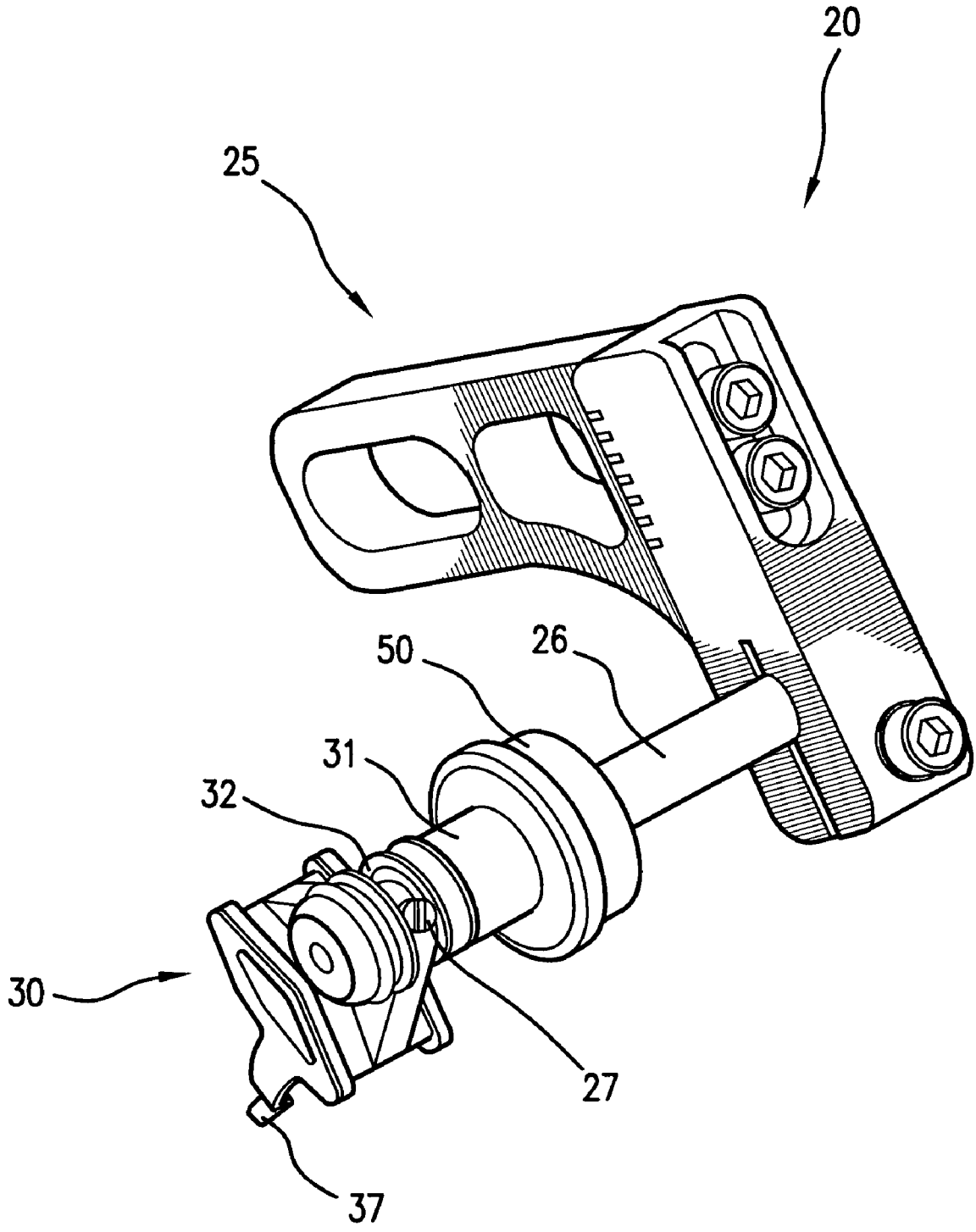
FIG. 2 is a rear perspective view of the arrow rest assembly, as shown in FIG. 1.

FIGS. 1-5 show different views of arrow rest 20, according to one embodiment of this invention. Arrow rest 20 comprises arrow holder 30 removeably connected with respect to shaft 26. FIG. 2 shows screw 27 connected to housing 50 and contacting shaft 26. Body 31 has recess 32 within which screw 27 is movably mounted. In certain embodiments of this invention, body 31 can pivot or rotate about shaft 26, by allowing screw 27 to ride within recess 32 as body 31 pivots, rotates or otherwise moves with respect to shaft 26.

Figure 6:
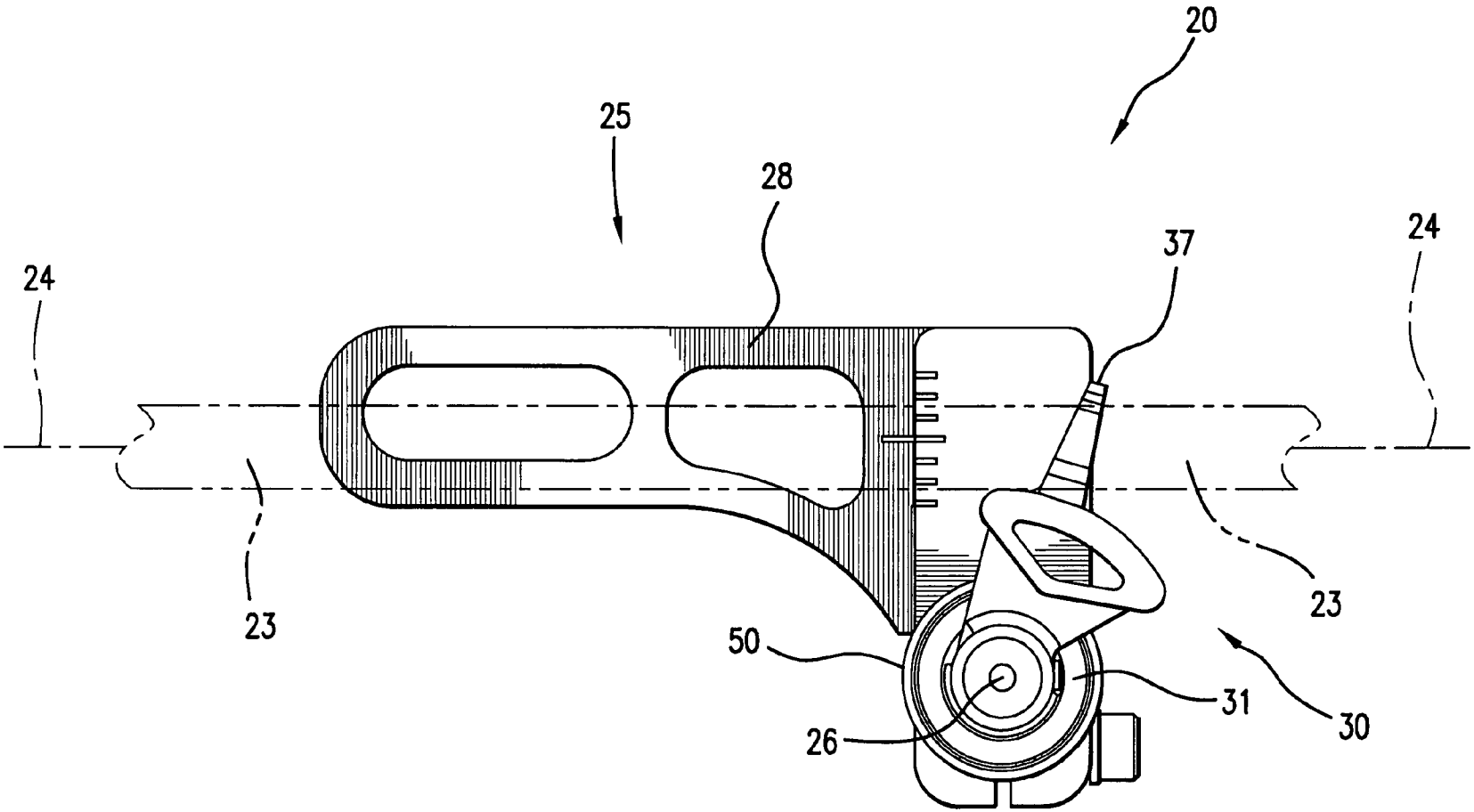
FIG. 6 is a side view of an arrow rest assembly, in one of different support positions, according to one embodiment of this invention.
Figure 7:
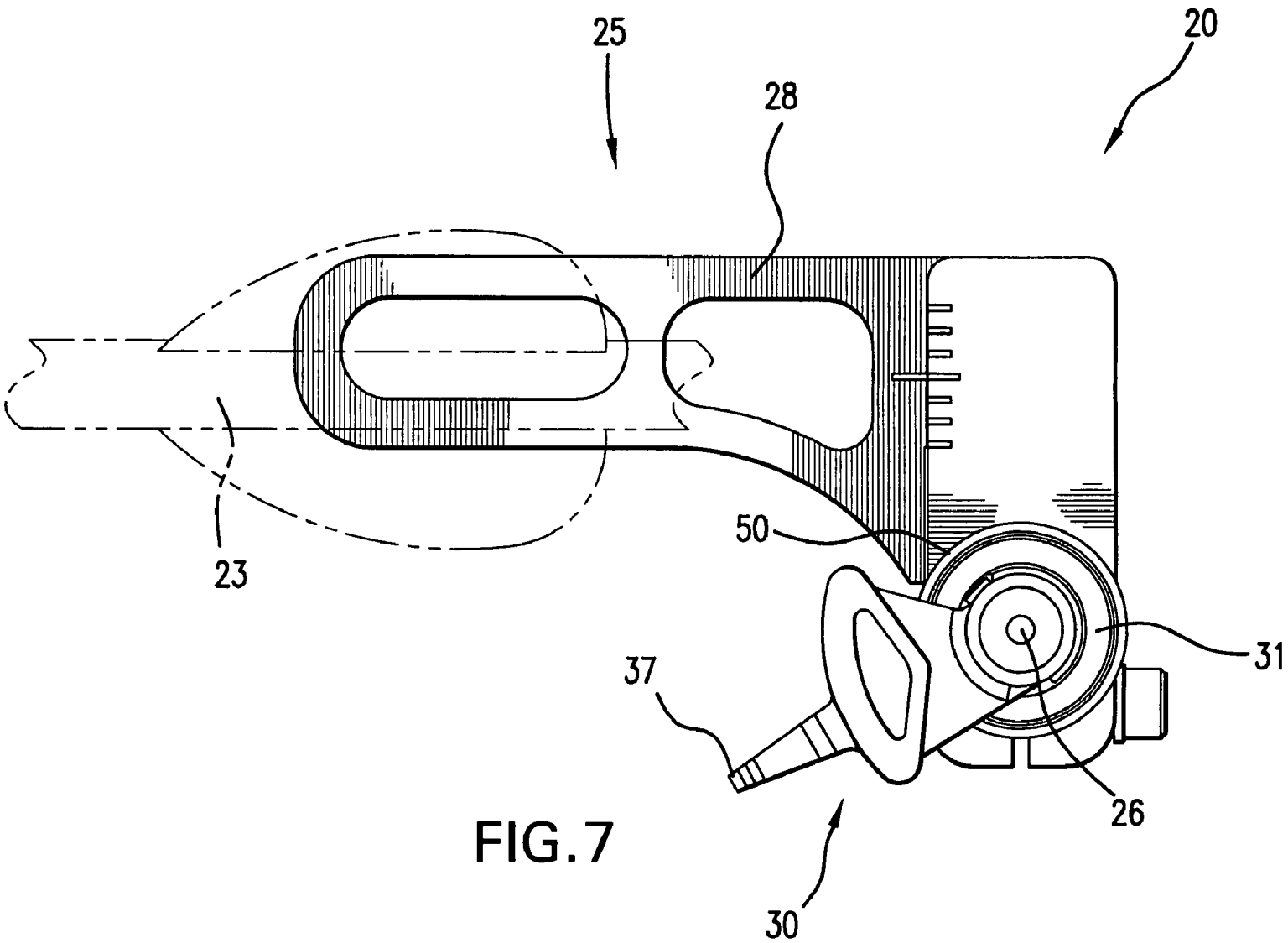
FIG. 7 is a side view showing the arrow rest assembly as shown in FIG. 6, but in a launch position.

FIG. 6 shows arrow rest 20 in one support position. Body 31 and thus arrow holder 30 can pivot or otherwise move about shaft 26. In certain embodiments of this invention, screw 27 and/or recess 32 can be sized, dimensioned and/or shaped to allow the pivotal or other movement of arrow holder 30 about shaft 26. The position of arrow holder 30 with respect to shaft 26 as shown in FIG. 6 can be varied by any desired angle or distance, to allow arrow holder 30 to move into any one of a plurality of support positions, such as the one shown in FIG. 6, where arrow holder 30 maintains shaft 23 in a loaded condition. FIG. 7 shows the same embodiment of arrow rest 20 as shown in FIG. 6, but with arrow holder 30 in a launch position where shaft 26 is discharged and away from arrow rest 20.

Many drop-away arrow rests are used to quickly or immediately move the arrow rest away from the arrow shaft and the corresponding fletching of the arrow. It is important for the arrow shaft and the arrow fletching to clear the arrow rest, to not interfere with the projectile path of the arrow or other projectile.

In many use situations, particularly when carrying an archery bow in the field, an arrow is loaded in the archery bow and the archer traverses through hunting terrain, searching for a target. Because the archery bow is moved into many different positions, including out of the vertical position or the shooting position, there is a tendency for the arrow shaft to fall away from its loaded condition with respect to the archery bow. By allowing arrow holder 30 of this invention to move between a plurality of support positions, one which is shown in FIG. 6, it is possible for shaft 23 to move forward and backward generally along a direction of longitudinal axis 24, without falling away from or out of arrow holder 30. Also, there are times when hunters draw an archery bow into a loaded condition and then back down or let down the bow, for example because the target moves away or the hunter decides to not shoot. Allowing arrow rest 30 to move between different support positions, one of which is shown in FIG. 6, allows shaft 23 to not fall away from or out of arrow holder 30. Thus, arrow holder 30 of this invention can be used to accommodate the different positions that an archery bow experiences during field transport as well as the let down or draw down that occurs when a hunter decides to not shoot a drawn archery bow.

As shown in FIG. 6, arrow holder 30 maintains shaft 23 in a loaded condition. Because arrow holder 30 can pivot, rotate or otherwise move with respect to shaft 26 and thus a connected archery bow, in each of the support positions, arrow holder 30 can maintain shaft 23 in a loaded condition, such as shown in FIG. 6. When arrow holder 30 moves from any support position to the launch position, such as shown in FIG. 7, the movement path can be sized and/or designed to provide clearance and thus eliminate interference as shaft 23 and any corresponding fletching move across or through arrow rest 20.

In certain embodiments of this invention, arrow holder 30 is operable between any one of the support positions, such as the support position represented in FIG. 6, and the launch position, such as shown in FIG. 7. In some embodiments of this invention, arrow holder 30 is maintained in at least one of the support positions until a movement force, such as a force generated by a discharging bow string, is transferred to arrow holder 30 with a magnitude and direction great enough to overcome a support force that normally urges arrow holder 30 into at least one of the support positions.

Any suitable force generating member can be used to normally urge arrow holder 30 into one of the support positions. The magnitude and direction of the force generated can be selected or designed to prevent arrow holder 30 from moving into the launch position under certain circumstances but still allow arrow holder 30 to move to the launch position under other circumstances.

In some embodiments of this invention, the support force can be greater than forces generated by letting down or drawing down the bow string, or repositioning or moving the archery bow out of the vertical or otherwise normal shooting position. The support force can be designed to be less than the magnitude and direction of a movement force which is transferred to arrow holder 30, for example when the bow string is released upon discharge. In certain embodiments of this invention, the movement force is designed to be greater than the support force so that when the movement force is transferred to arrow holder 30, arrow holder 30 moves from one of the support positions to the launch position.

In one embodiment of this invention as shown in FIGS. 1-5, a cam and follower mechanical arrangement is used to accomplish the support force necessary to maintain arrow holder 30 in one of the support positions while also allowing arrow holder 30 to move to the launch position when the movement force is greater than the support force, such as when the arrow is discharged from the archery bow.

Figure 3:
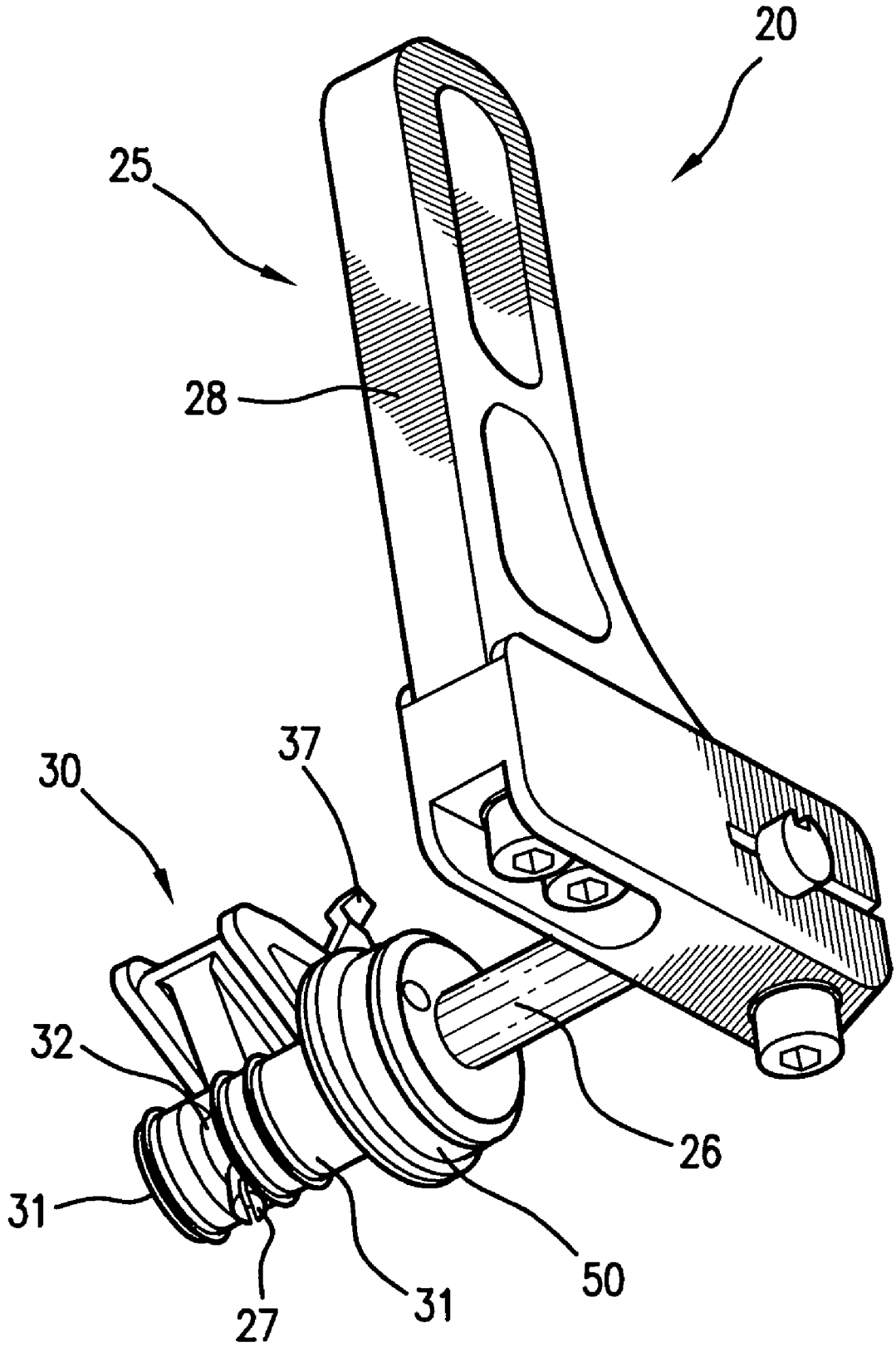
FIG. 3 is a perspective side view of the arrow rest assembly, as shown in FIG. 1.
Figure 4:
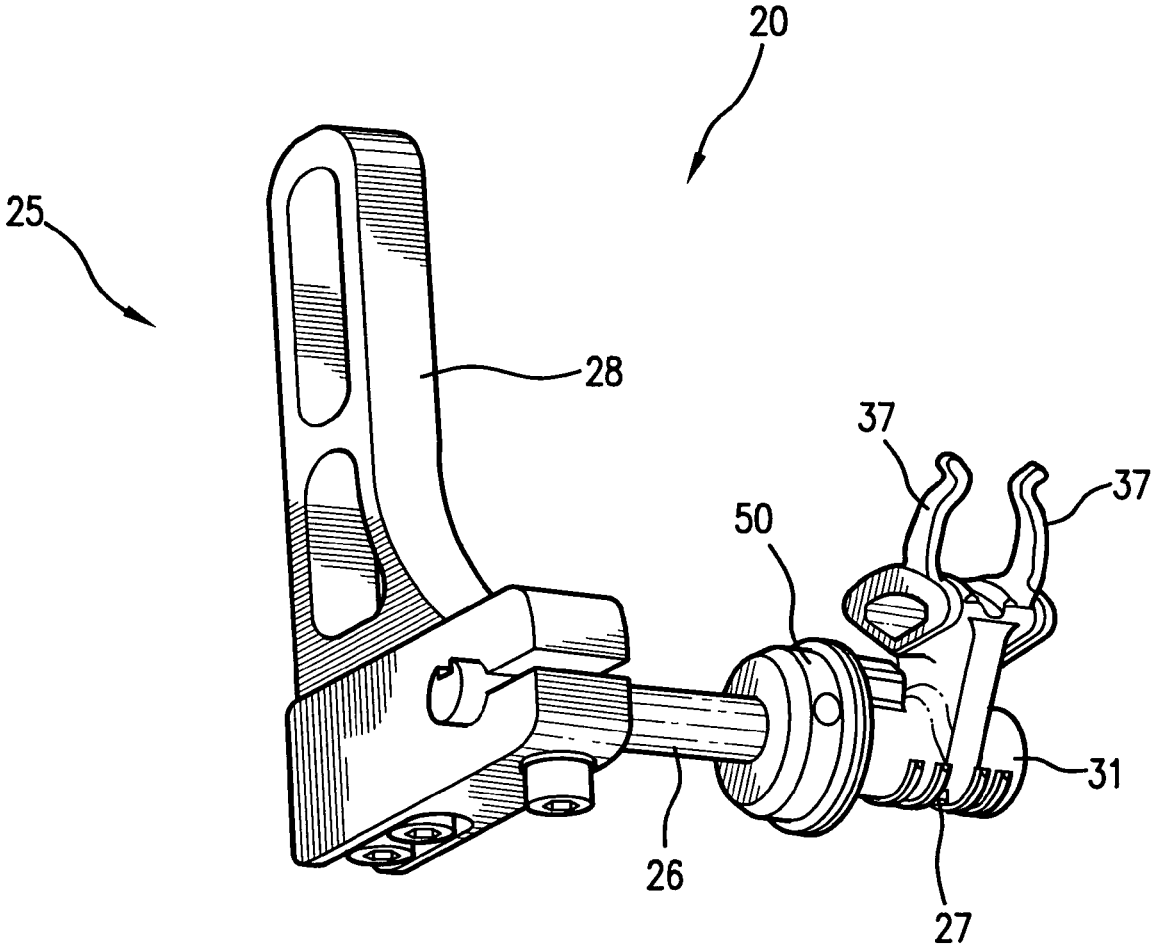
FIG. 4 is a perspective bottom view of the arrow rest assembly, as shown in FIG. 1.
Figure 5:
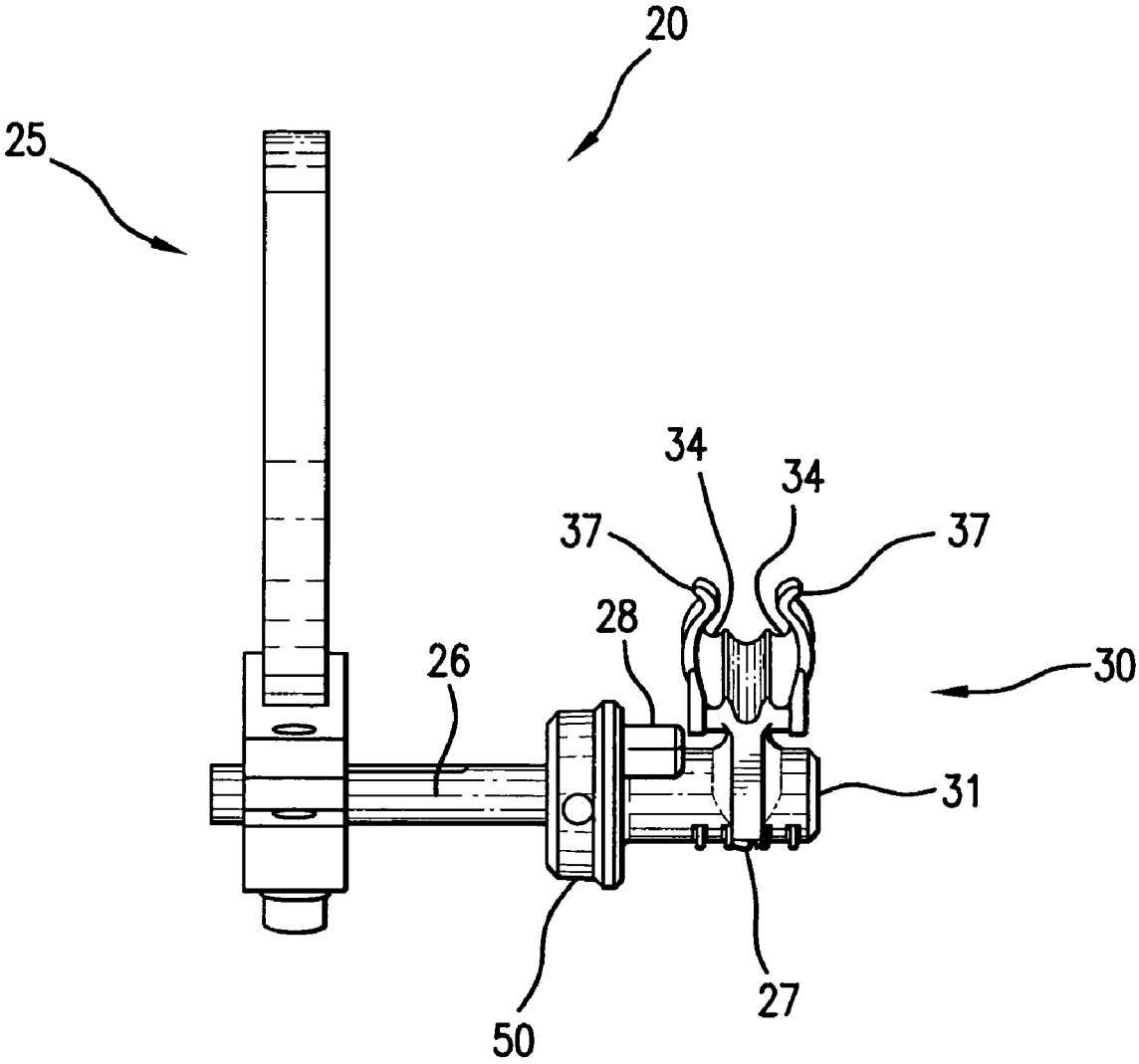
FIG. 5 is a front view of the arrow rest assembly, as shown in FIG. 1.
Figure 8:
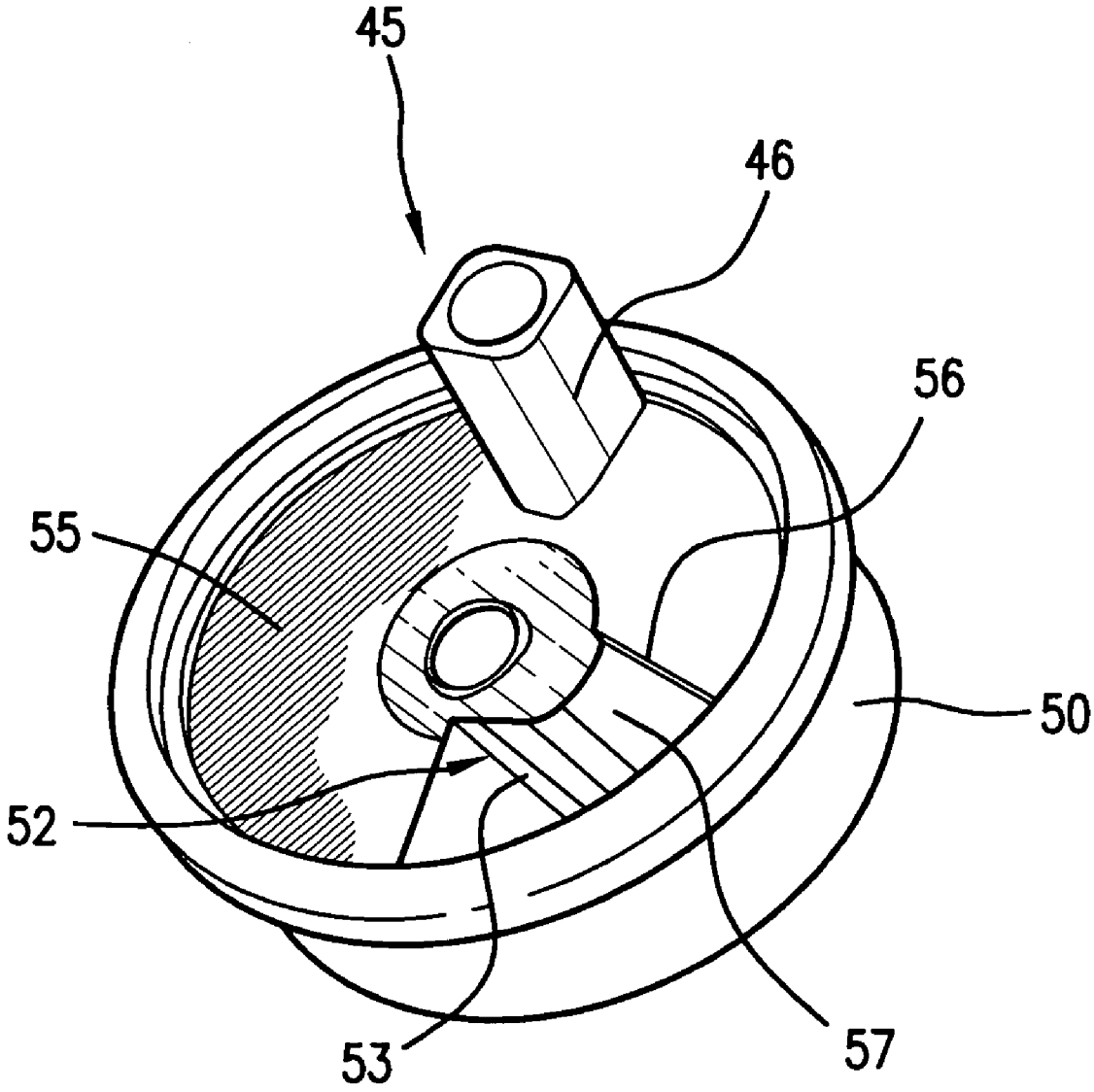
FIG. 8 is perspective side view of a cam and follower assembly, according to one embodiment of this invention.
Figure 9:
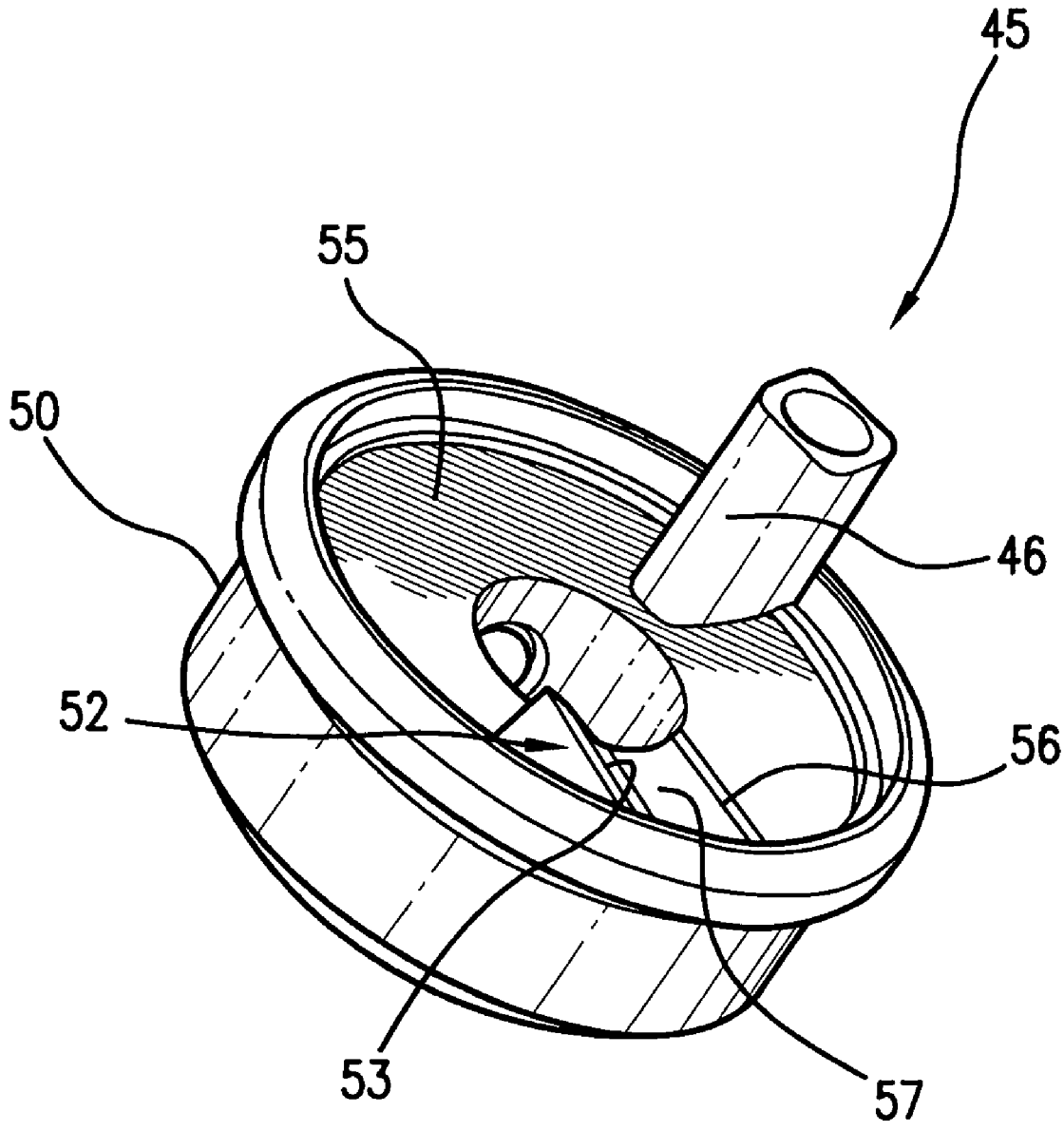
FIG. 9 shows the cam and follower assembly as shown in FIG. 8, but in a different perspective view.

FIGS. 8 and 9 each shows a different perspective view of cam 55 and follower 46, according to one embodiment of this invention. As shown in FIGS. 3-5, housing 50 is secured with respect to shaft 26 or another suitable structural member by using a set screw. Housing 50 can be connected or secured in any other suitable mechanical or other manner. In certain embodiment of this invention, housing 50 remains in a fixed position with respect to the archery bow.

FIGS. 1-5 show connector 25 and shaft 26 forming the mechanical connection between housing 50 and the archery bow. However, any other suitable structure or connection can be used to fix the relative position of housing 50 with respect to the archery bow.

When arrow holder 30 is mounted on shaft 26, as shown in FIGS. 1-7, arrow holder 30 can pivot, rotate or otherwise move with respect to housing 50. Any other suitable mechanical or other connection can be used to accomplish a similar relative movement.

Figure 15:
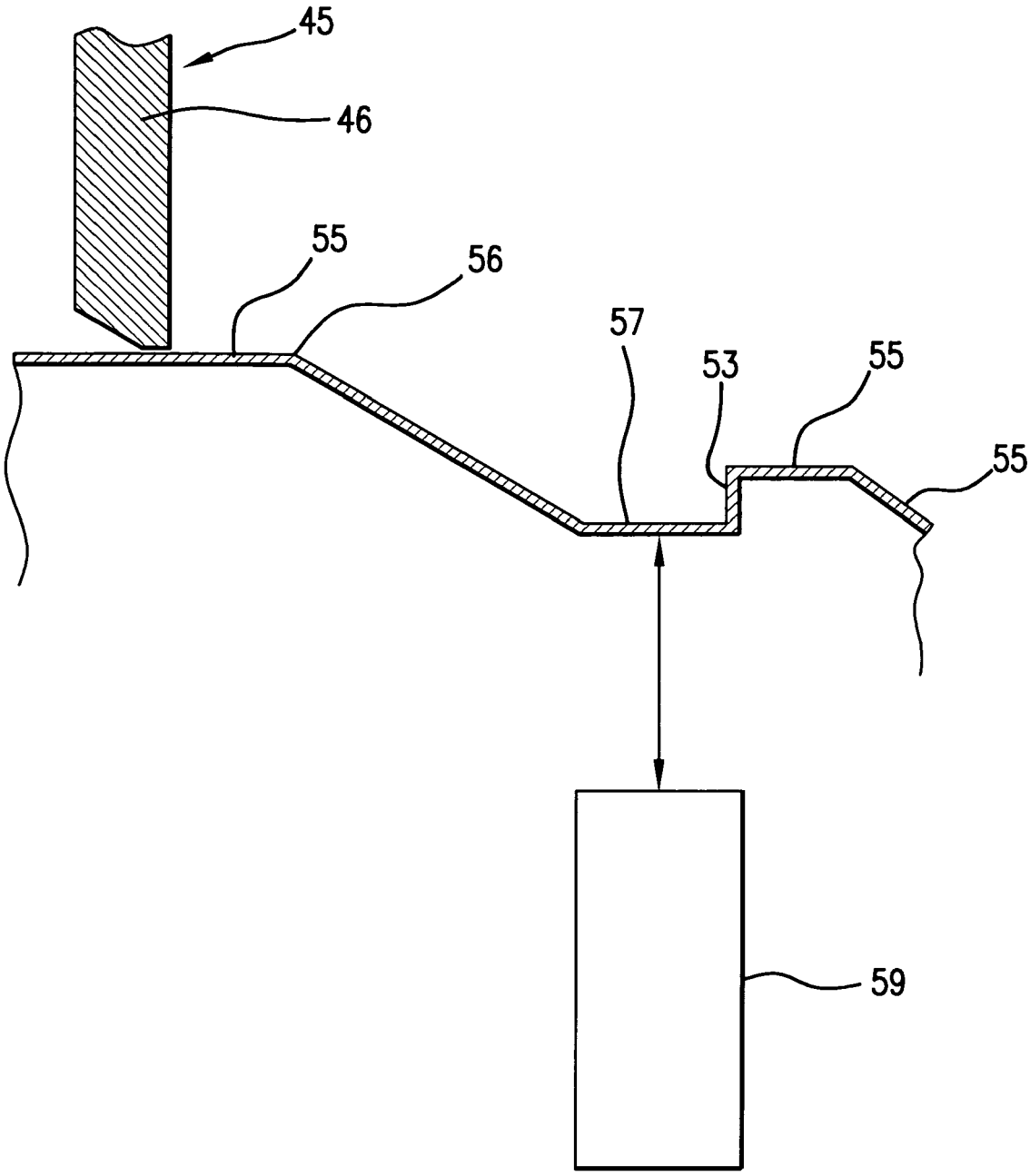
FIG. 15 is a schematic representation of a cam and follower arrangement, according to one embodiment of this invention.

FIGS. 1, 4 and 5 show body 31 forming casing 33 that houses follower 46. Follower 46 is moveably mounted within a void formed by casing 33. As body 31 of arrow holder 30 pivots, rotates or otherwise moves with respect to housing 50, follower 46 rides along or relative to cam 55, such as shown in FIGS. 8, 9 and 15.

As used throughout this specification and in the claims, the terms force, acceleration, velocity and speed are intended to be interchangeable with each other, and are intended to relate to the rate of relative movement between arrow holder 30 and housing 50, and thus between cam 55 and follower 46. When the rate of relative movement is relatively low, follower 46 reaches shoulder 56 of a ramp formed by cam 55 and then continues to move over gap 57 and makes contact with shoulder 53 which acts as stop 52. Because there is contact between follower 46 acting as lock 45 and shoulder 53 acting as stop 52, further relative movement of arrow holder 30 with respect to housing 50 is prevented, and arrow holder 30 cannot move into the launch position, such as shown in FIG. 7.

When the force, acceleration, velocity or speed transferred to arrow holder 30 is great enough to transfer a movement force that can overcome the support force that normally urges arrow holder 30 into one of the support positions, then follower 46 moves along cam 55 fast enough so that follower 46 jumps over gap 57 and clears shoulder 53 acting as stop 52 and allows arrow holder 30 to move beyond the support position and into the launch position, such as shown in FIG. 7, to provide clearance for the discharging shaft 23 and the associated fletching.

Figure 10:
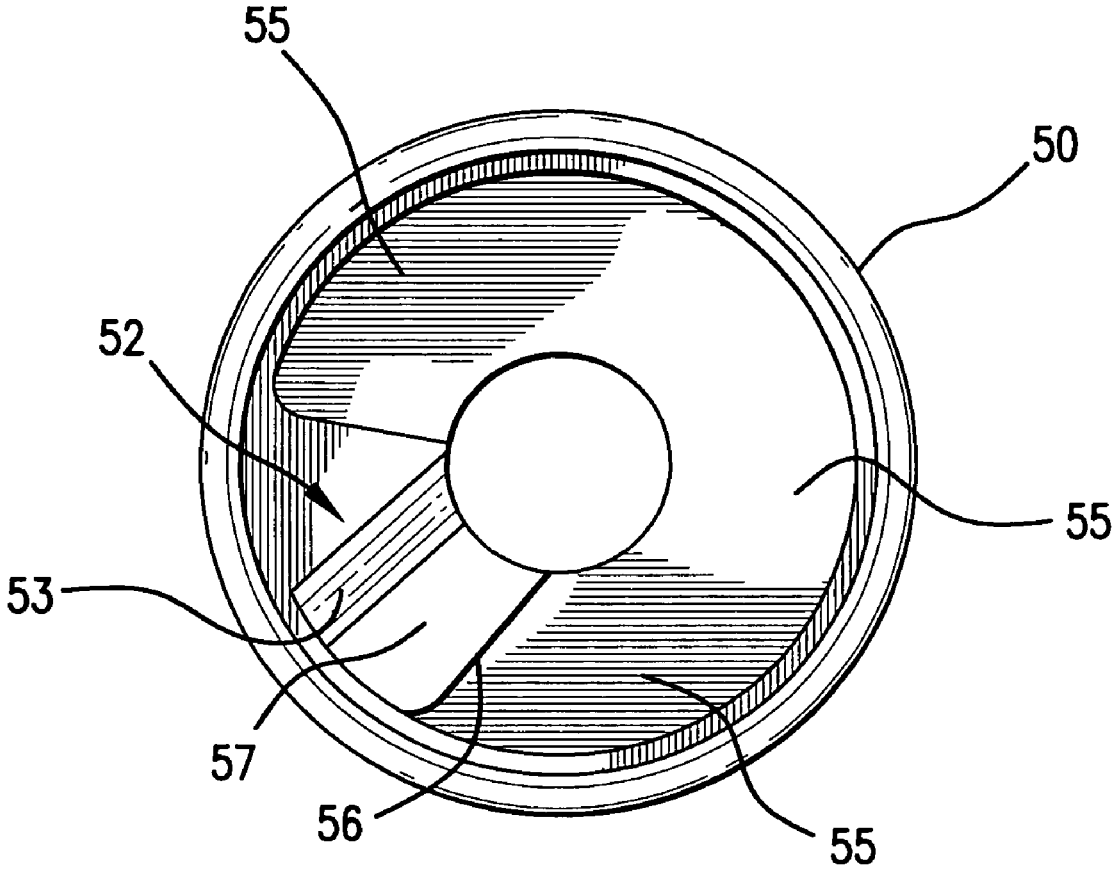
FIG. 10 shows a side view of a cam element, according to one embodiment of this invention.
Figure 11:
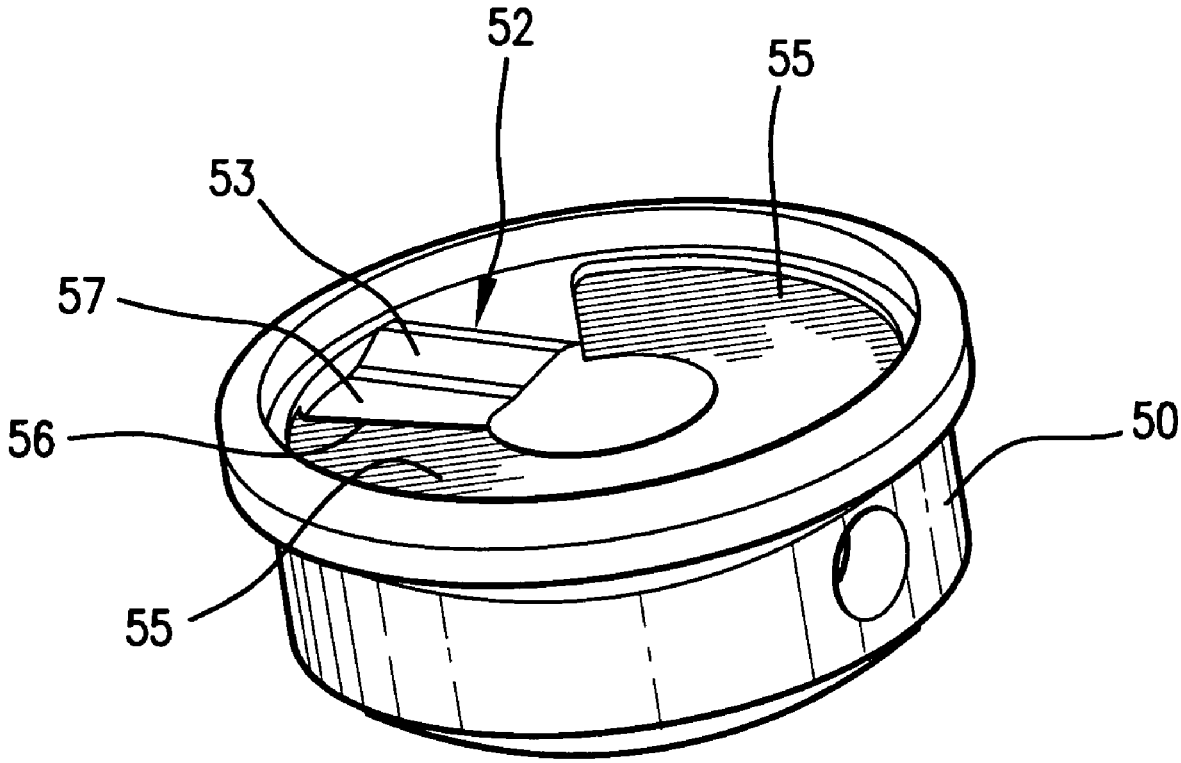
FIG. 11 shows a perspective view of the cam element, as shown in FIG. 10.
Figure 12:
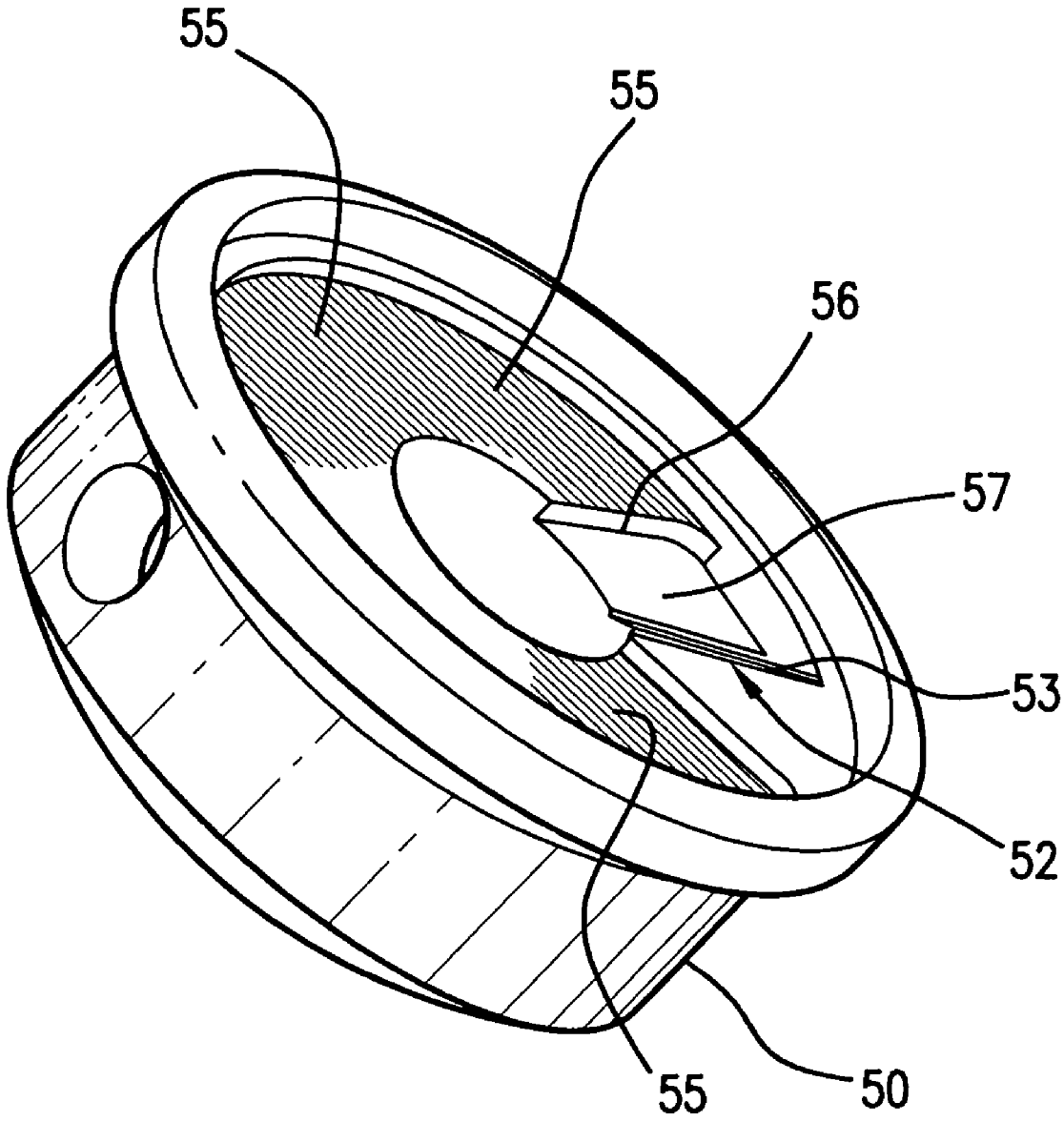
FIG. 12 shows a perspective view, different from the perspective view shown in FIG. 11, of the cam element as shown in FIG. 10.
Figure 13:
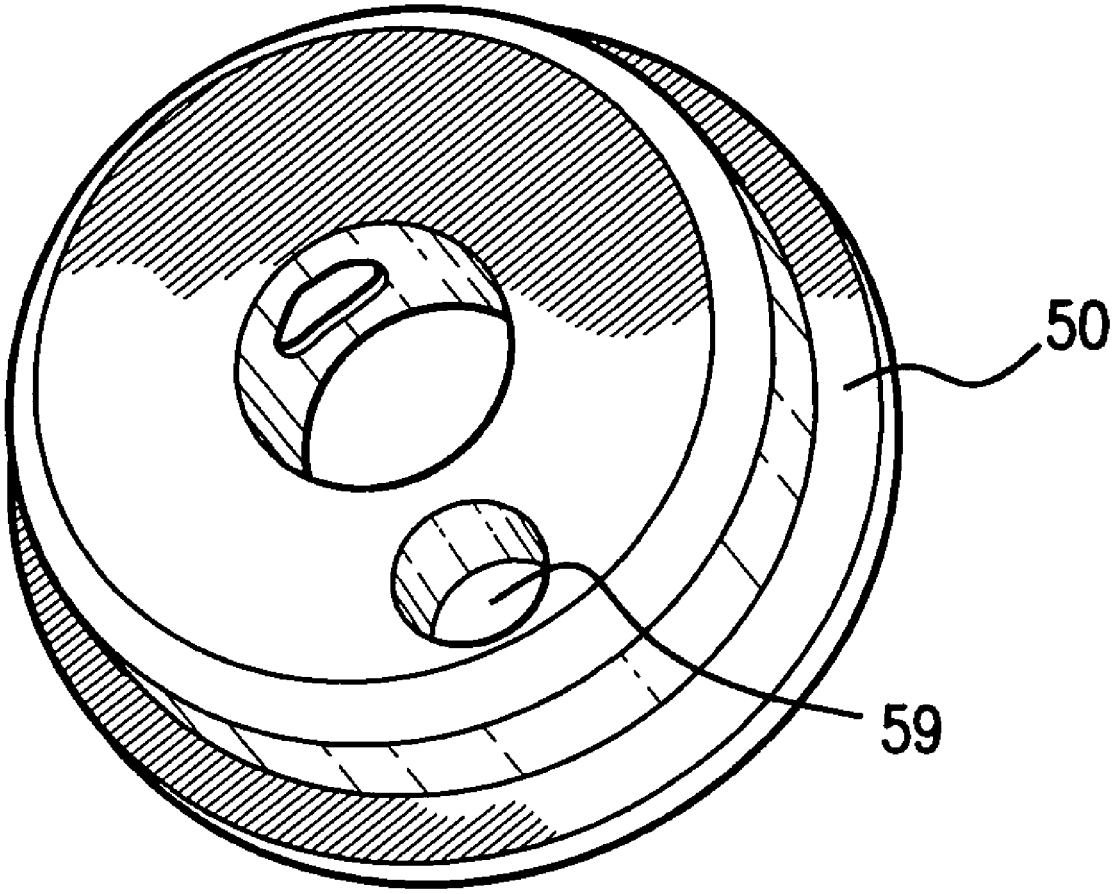
FIG. 13 shows a different perspective view of the cam element and its corresponding housing, according to one embodiment of this invention.
Figure 14:
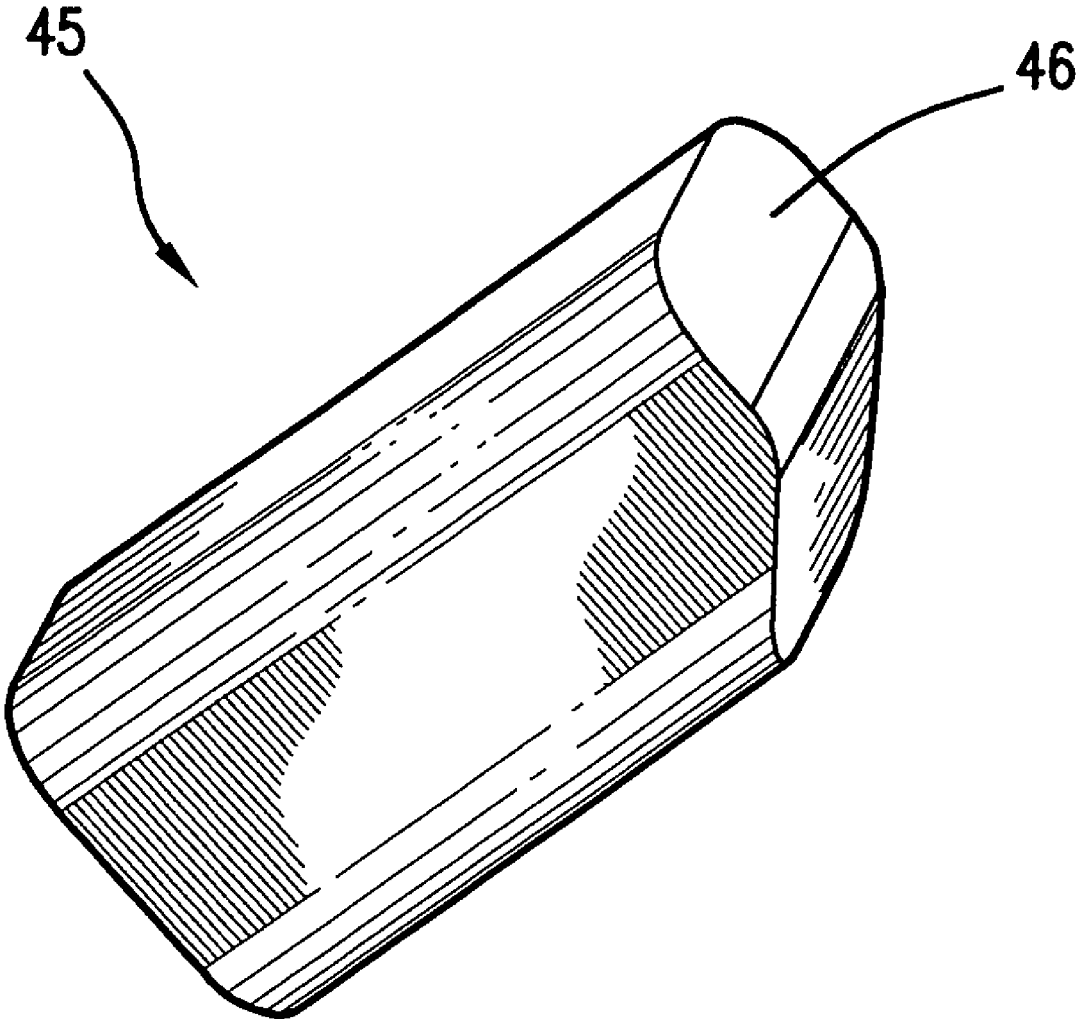
FIG. 14 shows a perspective view of a follower, according to one embodiment of this invention.

FIG. 10 shows one embodiment of a ramp surface forming cam 55. FIGS. 11 and 12 shown different perspective views of housing 50, according to one embodiment of this invention. FIG. 13 shows a rear perspective view of housing 50 where magnet 59 is mounted or positioned within a recess formed by housing 50. In certain embodiments of this invention, magnet 59 is positioned opposite but at or near gap 57, to draw by magnetic force follower 46 into gap 57 as arrow holder 30 moves with respect to housing 50. Any other suitable mechanical, electrical, electromechanical or other device or bias element can be used to apply a force to follower 46 in a manner similar to the force applied by magnet 59, such as shown in FIG. 13. The size and strength of magnet 59 and/or follower 46 can be varied to accomplish different forces and structural mounting requirements.

FIG. 15 shows a schematic representation of the operation between follower 46 and cam 55, such as shown in FIGS. 8 and 9 and described in the above specification. When follower 46 is in the position shown in FIG. 15, there is no or negligible pulling force acting upon follower 46 by magnet 59. As follower 46 moves along cam 55, a relatively slow acceleration or velocity will cause magnet 59 to draw follower 46 into gap 57 so that follower 46 interferes with shoulder 53 of housing 50, and thus stops arrow holder 30 from moving further and into the launch position. Referring to FIG. 15, when follower 46 moves relatively fast and has a relatively high acceleration or velocity, follower 46 jumps over, clears or prevents interference with shoulder 53 and thus follower 46 can move further into the launch position, so that arrow holder 30 moves away from a discharging shaft 23. In some embodiments of this invention, the forces acting upon discharging shaft 23 are transferred to arrow holder 30 and thus create the relatively high acceleration or velocity necessary to prevent interference between follower 46 acting as lock 45 and shoulder 53 acting as stop 52.

All of the elements shown in FIG. 15 can be sized and/or shaped differently to accomplish different movement results, depending upon the requirements for moving arrow holder 30 into the launch position.

Figure 16:
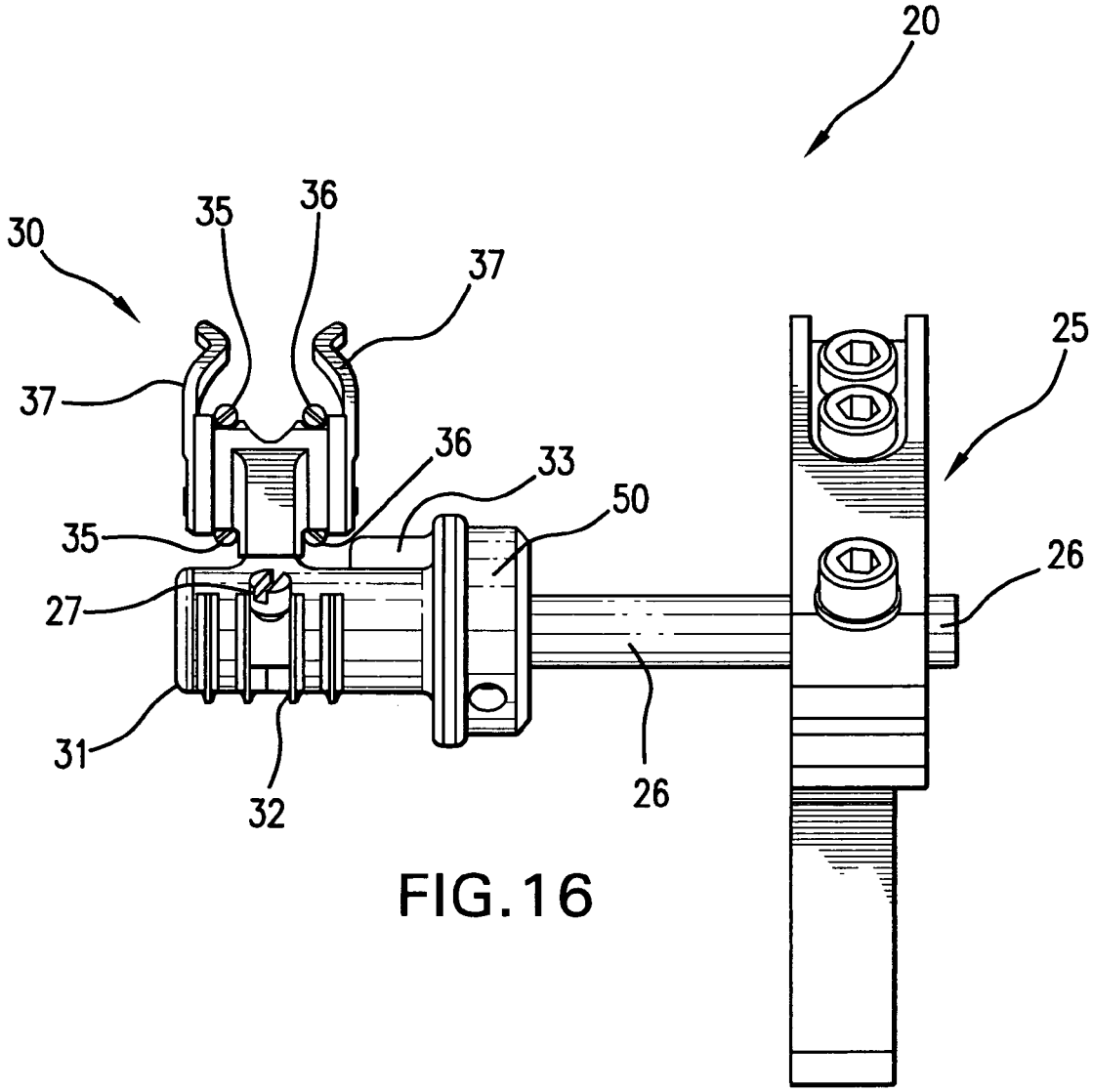
FIG. 16 is a rear partial sectional view of an arrow rest assembly, according to another embodiment of this invention.

In some embodiments of this invention, such as shown in FIG. 16, arrow rest 20 comprises a plurality of bands, such as band 35 and band 36, each fixed or mounted with respect to arrow holder 30. In some embodiments of this invention, band 35 is spaced at a distance from band 36. As shown in FIG. 16, at least a portion of each band 35 and band 36 is positioned generally parallel to a movement direction of arrow holder 30. FIG. 5 shows body 31 having grooves 34, each of which can accommodate band 35 or band 36.

In some embodiments of this invention, band 35 or band 36 extends about a continuous periphery of the arrow support portion of arrow holder 30, such as shown by the sectional lines in FIG. 16. In other embodiments of this invention, band 35 or band 36 can be a non-continuous length of band material mounted, secured or otherwise fixed with respect to body 31, in a manner similar to that shown in FIG. 16.

Band 35 or band 36 can be constructed of any suitable material. In certain embodiments of this invention, the material is a relatively durable elastic material with a relatively high co-efficient of friction, so that shaft 23 discharging over or through arrow rest 20 contacts and through friction transfers forces to arrow holder 30, such as the movement force necessary to overcome the support force and move arrow rest 30 into the launch position.

As shown in FIGS. 1-6, support arms 37 can be used to hold shaft 23 within arrow holder 30. Support arm 37 can be shaped and sized as shown in FIGS. 1-6, or support arm 30 can have any other suitable size and/or shape that can be used to hold or retain shaft 23 within arrow holder 30. Support arm 37 can be constructed of a resilient material or any other suitable material.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A drop-away arrow rest for supporting a shaft of a projectile prior to a launch of the projectile, the drop-away arrow rest comprising:

an arrow holder operable between a launch position and a plurality of support positions, in each of the support positions the arrow holder maintaining the shaft in a loaded condition, in the launch position the arrow holder releasing the shaft from the loaded condition;

a lock in combination with the arrow holder, wherein the lock engages when the arrow holder moves from a first of the support positions to a second of the support positions at less than a launch velocity, wherein the second of the support positions is between the first of the support positions and the launch position; and a support force operating on the lock to engage the lock when the arrow holder moves from the first of the support positions to the second of the support positions at the less than the launch velocity, wherein the arrow holder moves from the first of the support positions to the launch position at the launch velocity which is great enough to overcome the support force.

2. The drop-away arrow rest according to claim 1, wherein the arrow holder has a bias force urging the arrow holder into supporting contact with the shaft.

3. The drop-away arrow rest according to claim 1, wherein the arrow holder comprises an arm normally forced toward the shaft when the shaft is in the loaded condition.

4. The drop-away arrow rest according to claim 1, wherein in the loaded condition the arrow holder maintains the loaded condition of the shaft when the arrow holder moves between the first and the second of the support positions.

5. The drop-away arrow rest according to claim 1, wherein movement of the arrow holder between the first and the second of the support positions at a velocity less than a launch velocity prevents the arrow holder from moving to the launch position.

6. The drop-away arrow rest according to claim 5, wherein the arrow holder is movably mounted with respect to a housing, and a mechanical interference between the lock and a stop at the second of the support positions prevents the arrow holder from moving to the launch position.

7. The drop-away arrow rest according to claim 6, wherein the lock comprises a follower operable by movement of the arrow holder with respect to the housing.

8. The drop-away arrow rest according to claim 7, wherein the lock interferes with the stop when the arrow holder moves between the first and the second of the support positions at less than the launch velocity.

9. The drop-away arrow rest according to claim 8, wherein while the arrow holder moves from the first of the support positions to the second of the support positions, the follower rides along a cam surface fixed with respect to the housing and interferes with the stop.

10. The drop-away arrow rest according to claim 7, wherein the arrow holder moving at or greater than the launch velocity prevents the lock from interfering with the stop and allows the arrow holder to move to the launch position.

11. The drop-away arrow rest according to claim 10, wherein when moving to the launch position the lock avoids engagement with the stop.

12. The drop-away arrow rest according to claim 11, wherein while the arrow holder moves from the first of the support positions to the launch position, the lock rides along the cam surface and clears the stop.

13. The drop-away arrow rest according to claim 1, wherein the arrow holder comprises a first band and a second band each fixed with respect to a body of the arrow holder, and the first band is spaced at a distance from the second band.

14. The drop-away arrow rest according to claim 13, wherein the first band and the second band each has a portion positioned generally parallel to a longitudinal axis of the shaft when in one of the support positions.

15. A drop-away arrow rest for holding a shaft, the drop-away arrow rest comprising:

an arrow holder moveable between a first support position and a launch position;

a lock in combination with the arrow holder, the arrow holder moving between the first support position and a second support position at a first velocity that engages the lock to maintain the arrow holder in the second support position without the arrow holder moving into the launch position, and the arrow holder moving from the first support position to the launch position at a second velocity which is greater than the first velocity and that does not engage the lock, in each of the first support position and the second support position the arrow holder maintaining the shaft in a loaded condition, and when moving to the launch position the arrow holder releasing the shaft from the loaded condition.

16. The drop-away arrow rest according to claim 15, wherein a support arm has a support force that urges the arrow holder into the first support position or the second support position until a movement force transferred to the arrow holder is great enough to overcome the support force and move the arrow holder into the launch position.

17. The drop-away arrow rest according to claim 15, wherein movement of the arrow holder from the first support position to the second support position at the first velocity engages the lock with a stop to prevent the arrow holder from moving into the launch position.

18. The drop-away arrow rest according to claim 15, wherein movement of the arrow holder from the first support position to the second support position at the second velocity prevents engagement of the lock with a stop to allow the arrow holder to move into the launch position.

19. The drop-away arrow rest according to claim 15, wherein the arrow holder is movably mounted with respect to a housing, and a mechanical interference between the lock and a stop of the housing at the second support position prevents the arrow holder from moving to the launch position.

20. The drop-away arrow rest according to claim 19, wherein the lock comprises a follower operable by movement of the arrow holder with respect to the housing.

21. The drop-away arrow rest according to claim 19, wherein while the arrow holder moves from the first support position to the second support position at the first velocity, the follower rides along a cam surface fixed with respect to the housing and interferes with the stop, and while the arrow holder moves from the first support positions to the launch position at the second velocity, the lock rides along the cam surface and clears the stop.

22. The drop-away arrow rest according to claim 15, wherein the arrow holder comprises a first band and a second band each fixed with respect to a body of the arrow holder, and the first band is spaced at a distance from the second band.

* * * * *